US008828117B2

(12) United States Patent
Dressel

(10) Patent No.: US 8,828,117 B2
(45) Date of Patent: Sep. 9, 2014

(54) COMPOSITION AND PROCESS FOR IMPROVED EFFICIENCY IN STEEL MAKING

(76) Inventor: Gregory L. Dressel, Pawley's Island, SC (US)

( * ) Notice: Subject to any disclaimer, the term of this patent is extended or adjusted under 35 U.S.C. 154(b) by 310 days.

(21) Appl. No.: 13/135,242

(22) Filed: Jun. 29, 2011

(65) Prior Publication Data

US 2012/0024112 A1 Feb. 2, 2012

Related U.S. Application Data

(60) Provisional application No. 61/400,533, filed on Jul. 29, 2010.

(51) Int. Cl.
*C22B 9/10* (2006.01)
*B22D 11/108* (2006.01)

(52) U.S. Cl.
CPC ..... *B22D 11/108* (2013.01)
USPC ..... 75/526; 75/507

(58) Field of Classification Search
USPC ..... 75/526, 507
See application file for complete search history.

(56) References Cited

U.S. PATENT DOCUMENTS

| | | | | |
|---|---|---|---|---|
| 3,056,190 | A | 10/1962 | Chisholm et al. | 29/182.5 |
| 3,537,842 | A | 11/1970 | Holland | 75/58 |
| 4,094,666 | A | 6/1978 | Ototani | |
| 4,107,393 | A | 8/1978 | Frantzreb, Sr. et al. | 428/558 |
| 4,175,918 | A | 11/1979 | Frantzreb, Sr. | 428/567 |
| 4,342,590 | A | 8/1982 | Luyckx | 75/58 |
| 4,371,395 | A | 2/1983 | Ogletree | 75/129 |
| 4,698,095 | A | 10/1987 | Ototani et al. | 75/58 |
| 4,773,929 | A | 9/1988 | Weiner | 75/27 |
| 4,880,462 | A | 11/1989 | Meyer-Grunow | 75/253 |
| 5,205,856 | A | 4/1993 | Prinz et al. | 75/304 |
| 5,403,377 | A | 4/1995 | Masaie et al. | 75/304 |
| 6,355,089 | B2 | 3/2002 | Damie et al. | 75/567 |
| 6,508,857 | B2 | 1/2003 | King et al. | 75/526 |
| 7,682,418 | B2 | 3/2010 | Sarbendu et al. | 75/526 |
| 2009/0211400 | A1 | 8/2009 | Grong et al. | 75/305 |
| 2009/0277304 | A1 | 11/2009 | Ogawa et al. | 75/526 |
| 2011/0017018 | A1 | 1/2011 | Poulalion et al. | 75/304 |

FOREIGN PATENT DOCUMENTS

| | | | |
|---|---|---|---|
| EP | 1715065 | A2 | 10/2006 |
| GB | 1236123 | A | 6/1971 |
| JP | 2-163310 | A | 6/1990 |

*Primary Examiner* — Rebecca Lee
(74) *Attorney, Agent, or Firm* — Carla Gannon Law

(57) ABSTRACT

A method for reducing tundish and ladle nozzle clogging in a steel making process by introducing an additive into molten steel containers used in steel making at predetermined times. The additives introduced are oxides of iron which contain between 10% and 30% of oxygen by weight. By adding the oxides of iron in a controlled manner using a cored wire apparatus, clogs in tundish or ladle nozzles in the steel making process are avoided and the steel flows more smoothly with less interruptions due to clogged nozzles. A preferred embodiment uses oxides of iron contained in a cored wire which can be introduced at a predetermined rate and readily mix with molten steel, provide better distribution of dissolved oxygen in the steel to oxidize inclusions, and facilitate removal of the inclusions before the inclusions can cause nozzle clogging.

8 Claims, 4 Drawing Sheets

COMPOSITION AND PROCESS FOR IMPROVED EFFICIENCY IN STEEL MAKING

RELATED APPLICATIONS

This application claims benefit and priority from U.S. provisional application No. 61/400,533 accorded a filing date of Jul. 29, 2010.

FIELD OF INVENTION

This invention relates generally to a method and material for avoiding clogging of steel making apparatus by adding oxygen in the form of oxides of iron.

DESCRIPTION OF RELATED ART

Molten steel is normally produced in an Electric Arc Furnace (EAF) using primarily solid ferrous scrap or other solid iron derivatives or a Basic Oxygen Furnace (BOF) using hot molten iron containing up to 3.5% C and scrap or other solid iron derivative. In the EAF steel is melted using a combination of electrical and chemical energy. Melting of the scrap in the BOF process is accomplished by chemical energy alone. In both the EAF and BOF process, the molten metal is refined using a flux to remove some of the sulfur and most of the phosphorous while providing protection to the refractory lining. Oxygen is blown into the molten metal to remove carbon, phosphorous, aluminum, chrome and silicon from the molten bath through an oxidation process. The oxidation process is exothermic which causes heat to emit and take the molten metal up to the proper tapping temperature.

Once the molten steel is at the proper temperature and chemistry it is tapped from the EAF or BOF into a refractory lined ladle and taken to secondary steel making refining stage for further chemistry and alloy adjustments. Alloys such as ferro-silicon, silico-manganese, ferro-manganese, aluminum, nickel, chrome, molybdenum, vanadium and carbon may be added directly to the molten steel to adjust chemistry. Likewise, high calcium and dolomitic lime calcium carbide, calcium aluminate, spar and silica sand may be added to the slag floating on top of the molten steel in the ladle to adjust chemistry in the ladle.

Dissolved oxygen is typically removed by adding aluminum, silico-manganese, ferro-silicon, ferro-managese and carbon. All additions except carbon produce a solid oxide particle known as an inclusion.

Inclusions including silicates, aluminates and other oxide compounds remain in the steel. These create operational problems during processing of the steel and continuous casting and rolling, but are also detrimental to the quality of the steel. This is an ongoing challenge for the steel maker to reduce these undesirable elements and inclusions to an acceptable level in the final product.

Consequently, it has been found that certain materials may be added to the molten metal during the steel making process, which will reduce or eliminate undesirable inclusions in the molten metal. One method of introducing these desirable additives is the use of a cored wire injection. Use of cored wire injection in the steel making is known in the art. For example, Sarbendu et al, U.S. Pat. No. 7,682,418 describes a cored wire injection process. It describes a method of injecting cored wire into the liquid steel bath. Cored wire allows for release of additives while controlling the zone of release. The addition of additives can be controlled by changing dimensions of the cored wire and the speed of injection depending on the needs of the steel making process. Cored wire commonly has a outer coating, usually a continuous steel tube, which is filled with various additives, including lead, sulfur, selenium, tellurium, and bismuth as filling material. Cored wire containing calcium or mixture of calcium silicon is normally injected to liquefy alumina inclusions and ameliorate ladle and tundish nozzle clogging. A different type of cored wire method for treating molten metal is seen in King et al, U.S. Pat. No. 6,508,857. This is primarily an aluminum sheath forming a composite core with a calcium inner core encased in a steel jacket.

Production of silicon killed high carbon, low dissolved oxygen steel grades has a problem with tundish and ladle nozzle clogging. Tundish and ladle nozzle clogging is commonplace in silicon killed, high carbon, low dissolved oxygen grades. Symptoms of clogging manifest as a decrease in flow rate from the ladle to the tundish; a similar decrease in flow rate from the tundish to the mold with an associated decline in strand speed; and the formation of steel flow deflection buttons or "whiskers" on the bottom of the tundish nozzles. Signs tending to precede the occurrence of clogging in silicon-killed steels include the following:

1. Aluminum levels greater than 0.003% for steels with carbon levels >0.20%;
2. Dissolved oxygen levels under 20 ppm;
3. Sulfur removal levels greater than 30% using a white slag practice;
4. Dolomitic or Mag-Carbon ladle slag line material; and
5. Ladle Furnace heat working times in excess of 45 minutes.

Many solutions have been used to reduce the propensity for clogging in silicon killed steels: low aluminum ferro alloys; tundish slide gate nozzle change systems; calcium and calcium silicon wire injection systems; and increasing the oxygen content of the liquid steel in the ladle and tundish. Operators since the start of continuous casting have been increasing the oxygen content of the steel in the tundish to eliminate nozzle clogging. Typically the operators will stick an iron pipe lance into the molten steel in the tundish and blow gaseous oxygen. This can often lead to the formation of slag on the billet surface, increased levels of internals inclusions (dirt), pinholes or blowholes, chemistry changes with respect to Mn, Si and C, strand breakouts and increased dissolved nitrogen and oxygen levels. In all cases, uncontrolled increasing of the oxygen content of the steel is a poor option for eliminating nozzle clogs.

In a majority of steel melt shops, the final product is a continuously cast billet, bloom, slab or beam blank. Liquid steel in the ladle is of no commercial value. Castability is a very good measure of steel making process control. Steel making using the lowest cost process and raw materials is futile if the liquid steel cannot be cast into a semi-finished shape with the correct chemistry and level of cleanliness. A steel melt shop is producing at peak efficiency when the continuous caster is running smoothly and the strand operator is sitting in a chair taking very little action. If the caster operator needs to modify the liquid steel chemistry in the tundish or mold to correct existing nozzle clogging, then one can say there is a defect present in the steel making process.

White slag practices have been instituted in many silicon-killed shops that reduce FeO levels in the slag to less than 1%, which aids in the removal of sulfur from the liquid steel. While some have claimed to "invent" the white slag practice, a reference can be found in the 1951 edition of Making Shaping and Treating of Steel, pp. 517-518. At that time, the oxidizing slag in the EAF would be hand rabbled out using rakes and replaced by a reducing slag. The major difference today is that the EAF can be tapped essentially slag free and white slag can built and used in the ladle at the ladle furnace. Additionally, inert gas stirring in the ladle has greatly aided in the intermixing of steel and slag. Calcium carbide, calcium silicon fines, and ferro-silicon fines may be added to the ladle slag to reduce the FeO. As the FeO level drops in the slag likewise does the dissolved oxygen level in the steel. With a liquid slag and an accommodating V ratio (CaO %/$SiO_2$%), sulfur reduction of 60% or better to levels less than 0.010% S are possible at dissolved oxygen levels of 15 ppm. The big drawback to the white slag practice is that ladle and tundish nozzle clogging becomes much more commonplace.

Intrinsically, silicon killed steel ladle and tundish nozzle clogging can be traced to the following sources:

1. Alumina;
2. Manganese silicates;
3. Manganese-Silicate-Alumina inclusions;
4. Magnesium aluminate spinels; and
5. Cold steel temperatures.

Consider each of these is turn:

Alumina

Alumina, $Al_2O_3$ is the bane of all casters. Aluminum is the most cost effective deoxidizer but oxides of aluminum precipitate as alumina on nozzles surfaces and sinter together to block the flow of molten steel. Sometimes, metallic aluminum is used as a sacrificial deoxidizer in low carbon silicon killed steels. For silicon-killed steels with more than 0.10% C to which no sacrificial aluminum is added, the most common trace sources of aluminum are ferroalloys used in the steel making process. Calcium silicon wire may contain up to 1.5% aluminum. Other sources include calcium aluminate slag fluxes. While the use of calcium aluminate slag conditioner reduces the need for fluorspar to liquefy the ladle slag, metallic aluminum and vanadium oxide can be present depending on the source of the slag conditioner. The use of fluorspar is known to reduce ladle slag line life but if calcium aluminate is substituted for fluorspar, an operator runs the risk of increased aluminum levels in silicon killed steels and possibly a vanadium increase depending on the source of the calcium aluminate. Increased levels of vanadium lead to unpredictability in tensile strength. While refractory supervisors despise the use of spar, use of calcium aluminate slag, liquefiers containing metallic aluminum, and vanadium oxides on high carbon silicon killed grades limited to 0.003% AI, leads to nozzle clogging and chemistry problems so spar may be the only suitable slag liquefier.

Calcium and calcium silicon wire injection has been developed to promote the formation of a liquid calcium aluminate inclusion in steel. Calcium silicon lump is also added at various plants to aid in deoxidization and also help in the formation of a liquid calcium aluminate inclusion. In quite a few silicon-killed shops, calcium silicon wire is injected as a primary deoxidizer and desulfurizer. While this is effective in sufficient quantities, the use of a white slag can be considered as a less expensive alternative. With the white slag practice, calcium silicon wire can be injected in at levels less than 0.5 kilogram per metric ton of liquid steel, to liquefy remaining alumina in the steel.

Manganese Silicates

In silicon-killed steels, a liquid manganese silicate inclusion is typically produced at Mn/Si ratios greater than 3.4 to 1. At lower ratios, solid $SiO_2$ forms which can provide a base for tundish nozzle clogs. Lower Mn/Si ratios produce stronger deoxidization levels but with the use of a white slag practice, dissolved oxygen levels under 20 ppm can be produced. Obviously, either increasing the manganese or decreasing the silicon levels will increase the Mn/Si ratio. Decreasing the Si level is preferable and is entirely feasible when using a white slag practice. An operator must experiment to find the correct ratio for producing a molten manganese silicate but usually somewhere greater than 3.4 parts Mn to 1 part Si produces the desired result.

Manganese-Silicate-Alumina Inclusions

Paradoxically, increasing the silicon level leads to the formation of a liquid Manganese-Silicate Alumina inclusion. With increasing levels of aluminum, increasing the silicon level can lead to the formation of a liquid inclusion. Many steel plants produce high carbon silicon killed heats with about 0.20% Si. In many melt shops, occurrences of tundish nozzle clogging or whiskering correspond well to levels of Al greater 0.003%. So, an operator should increase Si content when the Al is greater than 0.003% but the major problem with this approach is that as the Si content is increased, the Al content likewise increases due to trace amounts of Al in the FeSi. The problem with increasing the Si level, in addition to incurring unnecessary costs, is that the Mn/Si ratio is decreased thus promoting the formation of solid silica.

Magnesium Aluminate Spinels

Another factor in tundish nozzle clogging is the formation of magnesium aluminate spinels. This problem occurs in high carbon heats with dissolved oxygen levels less than 20 ppm.

Under reducing conditions in high carbon, low dissolved oxygen steels, magnesium can be liberated from dolomitic or MgO—C slag line brick. Clogging tends to start and get worse at free oxygen levels less than 15 ppm for 1-36 grades. When a high carbon heat is worked for 45 minutes or longer with a white slag practice, the occurrences of magnesium aluminate spinel clogging becomes much more prevalent. Several treatments can be used to minimize tundish nozzle clogging due to spinels. First, white slag treatment of a ladle of molten steel should not be started until a caster delivery time is certain. Second, the addition of slag deoxidizers such as calcium carbide, ferro silicon, or calcium silicon fines should not be used to excess. Third, the white slag treatment times should be minimized. Finally, lime additions at the ladle furnace should be very limited since the slag V ratio would tend to increase. Lowering the slag V ratio increases the capacity of the slag to absorb magnesium aluminate spinels.

Cold Steel Temperatures

With the ready availability of liquidus formulae and years of casting experience, cold steel temperature is not a major factor in high carbon silicon killed steel caster nozzle clogging. Most steel temperature problems occur due to false temperature readings, cold ladles and tundishes and excessive inert gas stirring in the ladle. A vigorously stirred ladle can lose 2.67° C. per minute (5° F. per minute). Uniform training of operators in taking immersion temperatures needs to be enforced due to variability's in insertion depth and position. Furthermore, testing and calibration of temperature measuring equipment needs to be conducted on a regularly scheduled basis.

Current Practices to Prevent Clogging

Various methods are currently used to solve ladle and tundish nozzle clogging problems, but none are completely effective. Operators use an iron oxygen lance to knock off buttons or whiskers from the bottom of tundish nozzles. The ladle slag may be treated with sand and mill scale, which helps, but does not completely prevent nozzle clogging. Adding mill scale to ladle slag can cause sulfur to revert from the slag to the liquid steel in the ladle. This is a very unwanted result. Sand additions to ladle slag help to minimize clogging but can shorten ladle life and does not always eliminate ladle and tundish nozzle clogging. Sand additions also limit the ability of ladle slag to remove sulfur so when using sand, producing very low sulfur steel may not be possible. Removing the ladle to tundish shroud or putting an oxygen lance into the tundish often solves the tundish nozzle clogging problem, but does so at a cost of quality of the end product. The symptoms may be treated by tundish nozzle changers, but this does not solve the problem. Current practices for avoiding silicon killed steel nozzle clogging can be summarized as follows:

1. Minimize the aluminum level to 0.003%;
2. Add calcium or calcium silicon cored wire or calcium silicon lump to liquefy aluminates;

3. Maintain a Mn/Si ratio greater than 3.4 to 1;
4. Minimize the white slag treatment times to reduce formation of magnesium aluminate spinels;
5. Reduce the ladle slag V ratio by adding sand or wollastonite at the ladle furnace after all desulfurization is completed;
6. Increase the molten steel dissolved oxygen by blowing an oxygen lance in the open stirring eye or add mill scale to the slag; and
7. Maintain the temperature measuring equipment and be sure operators follow a uniform temperature measurement protocol.

Each of these seven items may reduce silicon killed nozzle clogging, but none either individually or in combination completely eliminate it. Sulfur can be reverted from the ladle slag to the molten steel if an oxygen lance is blown into the stirring eye or mill scale is thrown into the slag.

Fundamental Cause and Solution for Nozzle Clogging

Ladle and tundish nozzle clogging are primarily attributable to precipitation of alumina and magnesium aluminate spinel inclusions to the inner surface of nozzles. Alumina and magnesium aluminates spinel inclusions adhere to the nozzle surface and accrete until the cross sectional area is reduced and the throat of the nozzle is choked off. Alumina inclusion and magnesium aluminate spinel precipitation is closely linked to surface tension and wetting angle of liquid iron on alumina and magnesium aluminate inclusions. Inclusion precipitation from the molten steel to the inner nozzle surface is reduced as the surface tension of the molten steel is reduced. In molten steel, surface tension is strongly influenced by dissolved oxygen and sulfur.

Sulfur and oxygen sharply decrease liquid iron surface tension. Increasing sulfur allows for better flow of molten steel through a ladle or tundish nozzle. In many qualities of steel higher sulfur levels are to be avoided so increasing sulfur levels is not always a suitable option. Increasing amounts of dissolved oxygen have a very big influence on reducing nozzle clogging. Small amount of oxygen can be added to the steel without harming the physical properties.

Removing the ladle to tundish shroud or putting an oxygen lance in the tundish confirms this effect, however both methods have their drawbacks. When the ladle to tundish shroud is removed, steel can gain 10 to 30 ppm of nitrogen from the air. Increased nitrogen in steel can lead to undesirable changes in physical properties. Direct injection of oxygen using a lance leads to a very high local concentration of dissolved oxygen which can react with silicon and manganese to form manganese silicate inclusion. A small controlled addition of oxygen to the steel is needed which neither causes a nitrogen increase nor manganese silicate inclusions.

Dissolved oxygen strongly influences the contact angle of liquid iron on solid alumina. The lower the surface tension the lower the contact angle and thus the better the wetting of a solid inclusion by the molten steel. Alumina precipitation to the ladle and tundish nozzle is to be avoided so a lower contact angle indicates an increased propensity for wetting of a solid inclusion. To avoid clogging, wetting of the alumina inclusion by molten steel inside the ladle or tundish nozzle is very desirable. Clogging results in casting machine slowdowns and loss of productivity. At its worst, nozzle clogging can completely choke off an orifice and shut down a process. A choked off nozzle results in a machine turnaround, replacement of a refractory lined tundish, unnecessary steel scrap and down time. Down time is extremely expensive since it can never be replaced.

SUMMARY OF THE INVENTION

None of the current remedies for clogging are entirely satisfactory. Blowing oxygen into a ladle can result in sulfur increase in the molten steel. Simply adding mill scale can result in a sulfur reversion to the steel. Adding sand to the ladle slag does not always produce repeatable results and can result in increased ladle slag line wear. Removing the ladle to tundish shroud during a cast allows an uncertain 5 to 25 part per million increase in dissolved oxygen, but also causes an undesirable nitrogen increase in the steel. Operators located below the steel shroud are exposed to steel sparks and a potentially dangerous situation when the ladle for tundish shroud is removed. Injecting gaseous oxygen into the steel requires a water-cooled or refractory lance, a mechanism to raise and lower the lance, spare lances, gas regulation and water and gaseous oxygen piping.

The current invention uses a cord wire technology to inject a cored wire containing oxides of iron. Introduction of a cored wire containing oxides of iron provides a precisely measured method for adding oxygen to steel in the steel making process and eliminating ladle and tundish nozzle clogging. Injection of cored wire containing oxides of iron eliminates the hazards associated with removing the ladle to a tundish shroud during a cast. It provides a more precise control of dissolved oxygen and avoids unwanted nitrogen in the steel. Using a cored wire avoids mixing with slag on the top of the ladle and sulfur reversion. The cored wire melts approximately one-third to nine-tenths below the top surface of the ladle. Oxides of iron are released into the melt and immediately absorbed by the molten steel. Thereby there is no mixing with the slag layer, thus a sulfur reversion is completely eliminated. Nitrogen increases are completely eliminated. The equipment required to inject cord wire is much simpler than an oxygen lance. Cored wire only requires a stationary wire feeder, guiding tubes, and cored wire. Cored wire will allow higher aluminum ferro alloys to be used reducing the need to use higher cost low aluminum ferroalloys. The oxygen contained in the cored wire will convert metallic aluminum from the ferroalloys to alumina which is easy to float out of the steel and trap in the slag on top of the ladle. The current invention prevents casting machine slow downs and loss of productivity. It allows operators to run the casting process faster and increase machine efficiency while lowering per ton fixed costs. It is safer, adds service life to equipment, and allows lower cost aluminum ferroalloys to be used thus increases efficiency and lowers cost in producing the same quality steel grade as would be produced by conventional methods. This invention is designed to be neutral regarding the quality of the steel produced. This invention should have minimal, if any, effect on the quality of the steel being produced in the steel making process. Rather, the invention is designed to approve to efficiency of the steel making process and lower the cost of the resulting steel.

DESCRIPTION OF THE INVENTION

Figure 1:
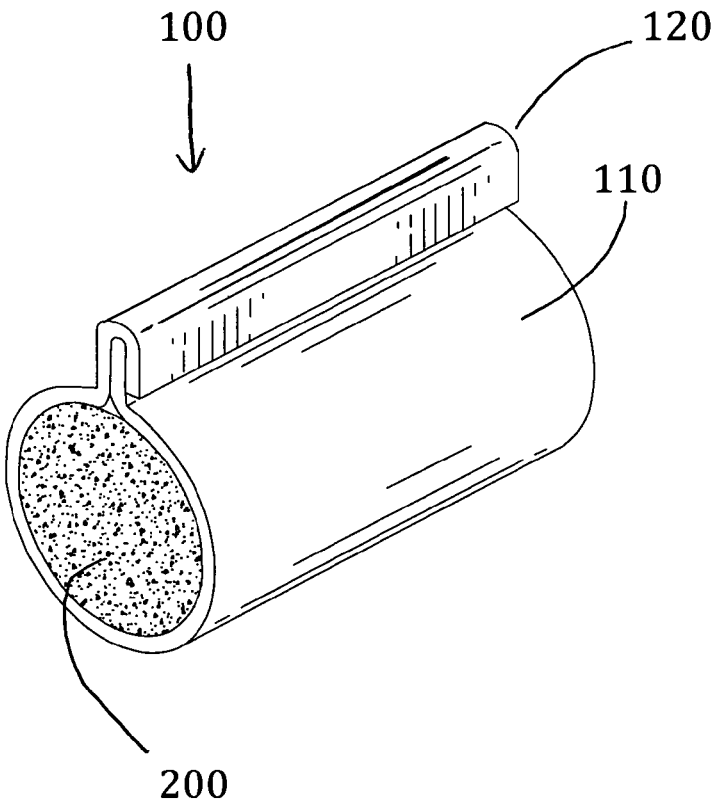
FIG. 1 is a cored wire showing filling material and raised seam prior to seam being bent flush.

FIG. 1 shows the cored wire (100) consists of a filling (200) made of a particular material and a metal jacket (110) made out of steel. The metal jacket (110) is usually made from a soft mild carbon steel ranging from 0.4 to 0.5 mm thick. The metal jacket (110) provides the following functions:

1. Contains the filling (200);
2. Keeps the filling dry (200);
3. Prevents the filling (200) from reacting in the liquid slag layer on top of the ladle; and
4. Provides rigidity for the filling (200) to penetrate into the molten steel.

The cored wire (100) is normally would into a coil (400) and place on a reel. The metal jacket (110) starts as a flat ribbon and is formed into the cylinder that holds the filling (200). The flat ribbon like material is bent into a cylinder with the seam (120) holding the filling (200) in place inside the cored wire (100).

Figure 2:
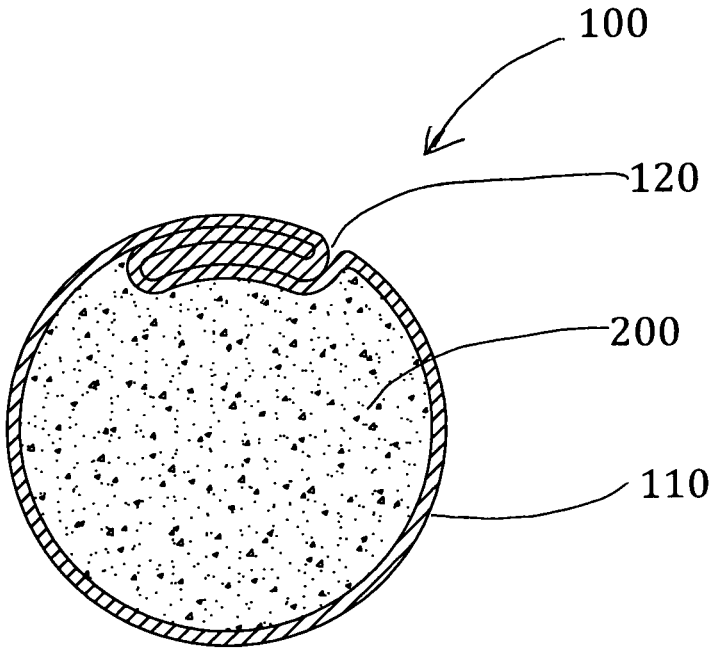
FIG. 2 is the cored wire showing particulate material and with the seam bent flush along the circumference of cored wire.

FIG. 2 shows the cored wire (100) with the seam (120) bent flush with along the circumference of the cored wire (100). The filling (200) should be composed of oxides of iron containing FeO, Wustite; $Fe_2O_3$, Hematite; and $Fe_3O_4$, Magnetite. One common source of oxides of iron is mill scale. The filling (200) is particulate matter usually crushed down to granular form with an average diameter ranging in size from 0.1 to 1.0 mm as well as more fine powder form. The filling (200) fills all of the interstitial space available inside the cored wire.

Figure 3:
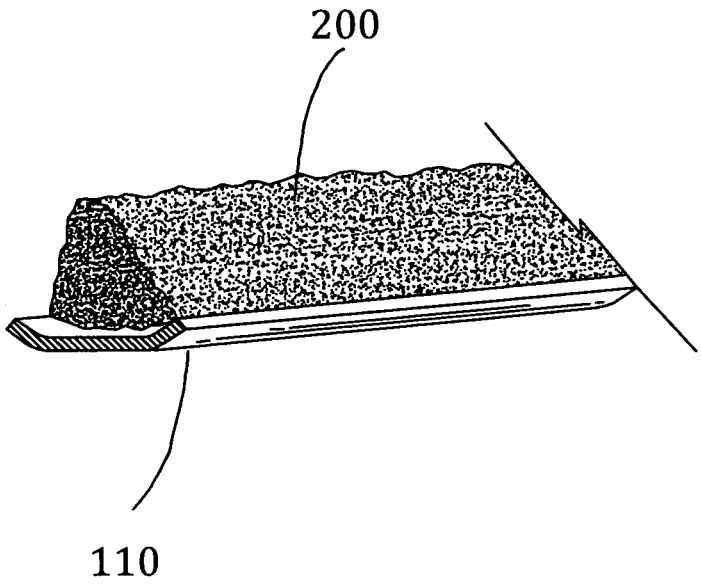
FIG. 3 is the particulate material on steel strip prior to being formed into a tube.

FIG. 3 shows the filling (200) on a ribbon like portion of the metal jacket (110) before the metal jacket (110) is formed into the cored wire (100) as shown in FIGS. 1 and 2. The ribbon like metal jacket (110) will then be formed into the cored wire (100) around the filling (200) and sealed with a seam (120) at the top. The seam (120) will be bent over flat onto the circumference of the cored wire (100). The cored wire (100) will then be wound into a coil (400) with weight of the coil ranging from 113.4 kg to 2268 kg (250 to 5000 lb).

Figure 4:
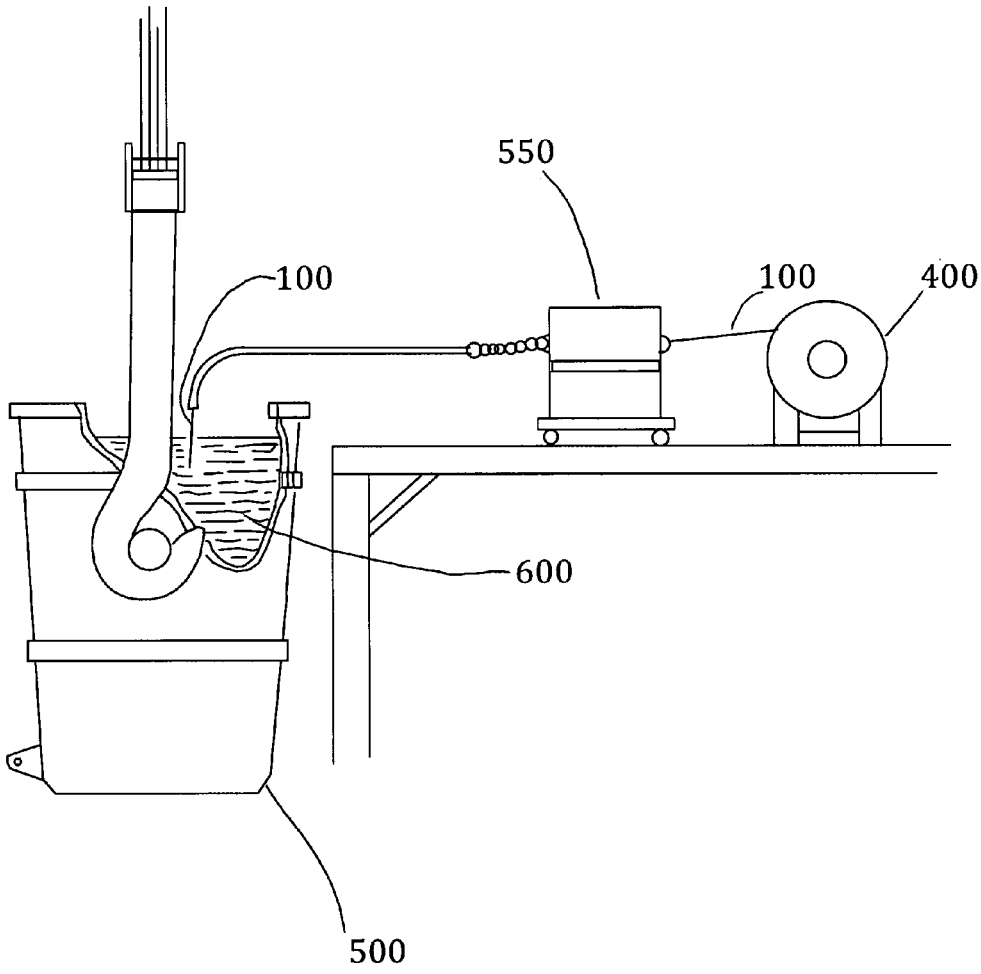
FIG. 4 shows the cored wire feeding into a ladle containing molten steel.

FIG. 4 shows the cored wire (100) feeding into a ladle (500) containing molten steel (600). A cored wire-feeding machine (550) is normally used to feed the wire (100) into a ladle. One end of the cored wire (100) is placed over the top of the ladle (500). The wire-feeding machine (550) is started and the cored wire (100) is advanced through the top layer of slag into the liquid steel (600) contained in the ladle (500).

The metal jacket (110) forming the outer shell of the cored wire (100) prevents premature melting of the filling (200) so reactions can take place in the molten steel (600) and not in the slag layer. The feeding speed can be varied to allow the melting of cored wire (100) at various depths in the ladle (500).

The current invention provides an improved method and apparatus for increasing and maintaining dissolved oxygen somewhere between one and 1,000 parts per million (ppm). Using conventional cored wire injection procedures, a cored wire (100) is injected into the ladle (500) in the silicon-killed steel making process. This cored wire (100) includes the usual metal jacket (110), a filling (200) that comprises a various forms of oxides of iron containing Wustite, hematite and or magnetite. Various oxides of iron have varying amounts of oxygen as a by-weight percentage. This percentage ordinarily varies between 10% and 30%. Therefore, the amount of iron oxide that is added to a metric ton of steel will depend in part on the percentage of oxygen in that particular iron oxide mixture as well as the desired parts per million of oxygen that may be added to a metric ton of molten steel in the ladle. The smallest amount of oxides of iron to add one part per million, assuming a 30% oxygen composition of the oxides of iron, requires 0.00333 kilograms of oxides of iron per metric ton of steel. Should the percentage of oxygen content of the oxides of iron, be lower, then higher amounts oxides of iron would have to be added to get to the one part per million. Similarly, if one wishes to add 1,000 parts per million to a metric ton of molten steel and assuming a 10% oxygen content in the added oxides of iron, the highest rate of addition of oxides of iron is 10 kilograms per metric ton. In industrial applications the actual range added will fall usually between the low of 0.00333 kilogram per metric ton and the high of 10 kilograms per metric ton of molten steel.

Using the current invention a typical ladle furnace practice would proceed as follows:

1. Complete all ladle furnace alloying and heating
2. During the alloying and heating process wire inject a cored wire (100) with a filling (200) composed as outlined above to get the dissolved oxygen to 5 to 1000 parts per million.
3. Add calcium or calcium silicon wire as needed.
4. Stir the bath enough to keep an eye open on top of the ladle.
5. Wire inject the cored wire (100) containing oxides of iron to get the dissolved oxygen up to 5 to 1000 parts per million.
6. Take the heat the caster.

Alternatively, one may wire feed the cored wire (100) containing the above materials at the caster. Injecting into the tundish is more difficult, but not impossible. Injecting the cored wire (100) in the ladle to tundish shroud or wire feeding it into the tundish may solve the tundish nozzle clogging issue, but it will not solve the ladle clogging issue.

Specific Examples of Industrial Applied Usage

Cored wire containing mill scale oxides of iron was fed into ladles containing 334 metric tons of silicon killed molten steel during a field trial. The cored wire was 13 mm in diameter, contained oxides of iron with an average oxygen content of 22%, with a oxides of iron content of 0.442 kg/linear meter (0.297 lb/linear foot). The composition of the oxides of iron components used for the field trial was Wustite, FeO, 75 to 80%, Magnetite, $Fe_3O_4$ was 15 to 20% and Hematite, $Fe_2O_3$ was 2 to 4%. The total % Fe was 73.7%. Total desired dissolved oxygen content in molten steel ranged from 1 parts per million to 1000 parts per million. The amount of addition of oxides of iron in a cored wire can range from 0.00333 kg/metric ton up to a 10 kg/metric ton of molten steel.

Oxides of iron are formed during hot reheating of steel slabs, billets, blooms or forgings. Steel is heated in furnaces to temperature up to 1454° C. (2650° F.). Air in the furnaces oxidizes the surface of the steel shape and forms oxides of irons in the form of FeO, $Fe_2O_3$ and $Fe_3O_4$. These oxides of iron are found on the bottom of reheat furnaces and along the furnace discharge and rolling path of the hot steel shape.

During processing at the ladle furnace three distinct phases were used for injecting the oxides of iron. The first phase (Phase I) for injection was just after receipt of the ladle at the ladle furnace. Injection at this time was done to oxidize metallic aluminum to alumina just after start of processing at the ladle furnace. The second phase (Phase II) for injection of oxides of iron was after the sulfur was removed from the molten steel (desulfurization). Injection at this time would remove the very small amount of magnesium dissolved in the steel and help prevent the formation of magnesium aluminate spinels. The third phase (Phase III) for oxides of iron injection was just after calcium or calcium silicon wire injection to provide a small increase in dissolved oxygen needed to prevent clogging.

The oxides of iron cored wire was injected into the ladle at speeds ranging from 152.4 to 304.8 m/min. Dissolved oxygen was measured using an oxygen probe prior to each oxides of iron cored wire injection and after the injection.

Trials were conducted on high carbon, >0.20% C and low carbon, <0.10% C silicon killed carbon steel grades. The trials showed an increase in dissolved oxygen in the molten steel. Some example quantitative trial results are listed below:

| | High Carbon Grades | | | Low Carbon Grades | | |
|---|---|---|---|---|---|---|
| Phase | Length of Oxides of iron Cored Wire Injected (meters) | Dissolved Oxygen ppm gain | Increase in Dissolved Oxygen (%) | Length of Oxides of iron Cored Wire Injected (meters) | Dissolved Oxygen ppm gain | Increase in Dissolved Oxygen (%) |
| I | 102.7 | 21.3 | 484.0 | Not Trialed | Not Trialed | Not Trialed |
| II | 37.8 | 10.3 | 183.9 | 196.9 | 52.1 | 500.9 |
| III | 120.0 | 8.2 | 482.4 | 19.5 | 5.8 | 40.3 |

The oxides of iron produced an increase in the dissolved oxygen in the molten steel. At the caster the tundish to ladle shroud was kept in place 100% of the time indicating that caster nozzle clogging did not occur during the trials. While the oxides of iron-cored wire injection was in use, no casting speed slowdowns indicating nozzle clogging were observed. No sulfur increases occurred in the molten steel indicating that no reversion occurred from the slag to the molten steel.

The forgoing description is by way of explanation and not of limitation. The only limitations are in the claims which follow.

I claim:

1. A method for reducing tundish and ladle nozzle clogging a in a steel making process by increasing dissolved oxygen comprising:

(a) introducing a cored wire including only one oxide additive, said oxide additive consisting of oxides of iron, into molten steel in a container used in steelmaking, said additive introduced in an amount ranging from 0.00333 to 10 kilograms of additive per metric ton of molten steel; and (b) inducing a source of oxygen to increase the dissolved oxygen content in said molten steel.

2. The method for reducing tundish and ladle nozzle clogging according to claim 1 wherein said additive is a mixture containing FeO, $Fe_3O_4$, and $Fe_2O_3$.

3. The method for reducing tundish and ladle nozzle clogging according to claim 2 wherein said step of introducing a cored wire adds oxygen to said molten steel at an amount no less than one part per million to no more than 1,000 part per million.

4. The method for reducing tundish and ladle nozzle clogging according to claim 2 wherein said step of introducing a cored wire includes employing a granular mixture having an average diameter of 0.1 to 1.0 mm.

5. The method for reducing tundish and ladle nozzle according to claim 1, further including the initial step of allowing all ladle furnace alloying and heating to occur in said steel making process prior to said step of introducing a cored wire.

6. The method for reducing tundish and ladle nozzle clogging according to claim 5 further comprising the step of injecting a second cored wire containing oxides of iron to get dissolved oxygen in said molten steel to a range of 5 to 1,000 parts per million, said second injection step performed after desulfurization in said steel making process.

7. The method for reducing tundish and ladle nozzle clogging according to claim 6 further comprising the step of injecting a third injection of cored wire timed to take place after a calcium or calcium-silicon additive is added to said molten steel in said steel making process.

8. The method for reducing tundish and ladle nozzle clogging according to claim 7 wherein said steps of injecting a first, second, and third cored wire each further comprise the respective steps of controlling the speed of said first, second, and third injections, thereby controlling the depth of the addition of the additive to the molten steel in said container holding said molten steel.

* * * * *